United States Patent [19]

Ueda

[11] 4,061,088

[45] Dec. 6, 1977

[54] ELECTRIC DETONATING FUSE ASSEMBLY

[75] Inventor: Masahiro Ueda, Toyota, Japan

[73] Assignee: Toyota Jidosha Kogyo Kabushiki Kaisha, Toyota, Japan

[21] Appl. No.: 694,080

[22] Filed: June 9, 1976

[30] Foreign Application Priority Data

Nov. 13, 1975 Japan ..... 50-136685

[51] Int. Cl.[2] ..... F42B 3/18

[52] U.S. Cl. ..... 102/28 R

[58] Field of Search ..... 102/28, 28 M; 338/20

[56] References Cited

U.S. PATENT DOCUMENTS

| | | | |
|---|---|---|---|
| 2,086,548 | 7/1937 | Handforth | 102/28 M |
| 2,408,125 | 9/1946 | Rolfes | 102/28 M |
| 2,974,590 | 3/1961 | Ramer | 102/28 |
| 3,318,243 | 5/1967 | Miller | 102/28 M |
| 3,426,682 | 2/1969 | Corren et al. | 102/28 |
| 3,496,512 | 2/1970 | Matsuoka et al. | 338/20 |

*Primary Examiner*—Verlin R. Pendegrass
*Attorney, Agent, or Firm*—Koda and Androlia

[57] ABSTRACT

An electric detonating fuse assembly for preventing abnormal ignition caused by static electricity, which incorporates a tubular body member including an igniting charge and an explosive charge, a filament disposed in the vicinity of the igniting charge, terminal leads to supply igniting currents to the filament, and a non-linear resistor element disposed between the terminal leads and the tubular body member. The resistor element sets a critical point between the normal igniting voltage and the starting voltage of the sparking discharge. The resistor element presents a low resistance value upon application of a supply voltage greater than the voltage at the critical point.

5 Claims, 8 Drawing Figures

ELECTRIC DETONATING FUSE ASSEMBLY

BACKGROUND OF THE INVENTION

1. Field of Invention

The present invention relates to an electric detonating fuse assembly, and more particularly to a new and improved electric detonating fuse assembly capable of preventing abnormal ignition such as an accidental discharge caused from static electricity.

2. Prior Art

Generally, the electric detonating fuse assembly or squib has been widely used in the past as an igniting device which causes to explode an explosive compound, a rocket propellant and the like. Particularly, in recent years it serves as one which in turn ignites a trigger actuator of a protective air bag or expansible confinement for protecting an occupant or occupants of a vehicle from severe vibration and shock conditions upon the occurrence of a collision. As best seen in such applications, it is required that the electric detonating fuse assembly provide extremely high safety and reliability of operation. For example, it will be apparent that when the trigger actuator of a protective air bag is suddenly ignited, irrespective of the sensing of any shock conditions of the vehicle, to expand the protective air bag, very dangerous conditions may be encountered with respect to the occupants of the vehicle. Therefore, it is required that the electric detonating fuse assembly provide a safe construction and electric circuitry of the type which prevents such abnormal ignition thereof. In general, the electric detonating fuse assembly comprises a construction in which an igniting charge enclosed in the tubular body member of the fuse assembly is to be ignited upon application of electric current through a filament positioned in the vicinity of the igniting charge. It has been well known that in the electric detonating fuse assembly of this type that the abnormal ignition thereof is mainly caused by the action of the static electricity being accumulated. When a static voltage charged in a filament electrode or a metallic tubular body member reaches a certain level of voltage, a discharge occurs between them. If this discharge energy exceeds a predetermined value, the igniting charge is activated to give rise to an abnormal ignition. Particularly, the trigger actuator for the protective air bag is susceptible to be charged with static electricity since it is usually connected in the vehicle where static electricity is very likely to be produced and stored cumulatively. Under these use conditions, serious problems are encountered due to such abnormal ignition caused by the accumulated static electricity.

It is impossible to prevent the charging action itself described above. However, if the discharge energy is reduced, abnormal ignition will not be caused. Based on this, the prior art electric detonating fuse assembly is so constructed that spark gap is provided between the filament electrode and the tubular body and with sufficient separation from the igniting charge. This arrangement ensures that before reaching a critical level of potential to cause an abnormal ignition, the accumulated static electricity is discharged through a spark discharge occurring earlier at the spark gap. Such conventional apparatus normally needs to provide a spark gap of the type having a low firing potential. It has been, however, very difficult to fabricate such a discharge gap and yet have high accuracy in construction. Particularly since the firing potential of the discharge gap is sensitive to the surface conditions of the discharge electrodes and their gap distance, it has been difficult to consistently maintain the discharge voltage thereof at a certain fixed value. In the event, also, that electric charges are concentrated on the discharging surface in a short time, it is feared that high voltage discharge will be effected through the spark gap between the filament electrode and the tubular body member of the electric detonating fuse assembly thereby causing a discharging delay. Therefore, it was impossible to prevent the abnormal ignition completely.

SUMMARY OF THE INVENTION

The present invention has been devised to obviate such conventional disadvantages as mentioned above.

Accordingly, a principal object of this invention is to provide a new and improved electric detonating fuse assembly.

Another object of this invention is to provide an electric detonating fuse assembly which eliminates an abnormal ignition caused from the discharge energies of static electricity.

To this end, the electric detonating fuse assembly according to the present invention is characterized in that a non-linear resistor element which presents very high resistance in a range up to a certain fixed voltage and shows very low resistance in a range beyond the same voltage is connected between the filament electrode and the metallic tubular body member. This certain fixed voltage is set at a value which is sufficiently smaller than a discharging voltage value which causes the abnormal ignition within the metallic tubular body member. As a result of this, the abnormal ignition is prevented wherein an electric discharge is not accomplished since static electric charge will flow through a non-linear resistor element having low resistance when the charge voltage reaches a certain fixed voltage described above. In the case of normal ignition, there is no preventing of the flow of electric current through a filament since a non-linear resistor element shows very high resistance.

Having so far described this invention, the above and further objects, features and advantages thereof will readily be recognized by those skilled in the art from the following description of a preferred embodiment thereof, illustrated in the accompanying drawings.

DETAILED DESCRIPTION OF THE PREFERRED EMBODIMENT

The preferred embodiment of the present invention will be explained below in accordance with the drawings.

Figure 1:
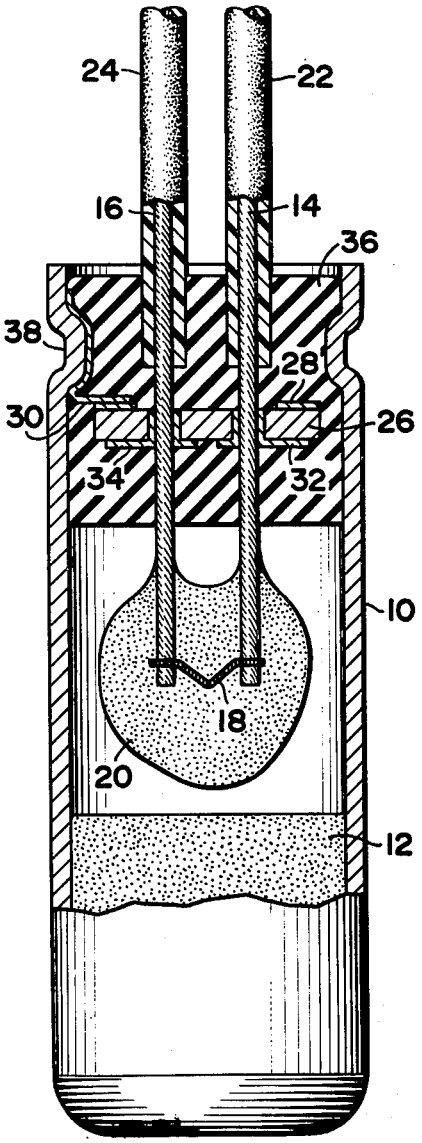
FIG. 1 is a cross-sectional view showing the main structure of a first embodiment of an electric detonating fuse assembly according to the present invention.

In FIG. 1, there is illustrated an electric detonating fuse assembly which is available as a trigger actuator for a protective air bag. A metallic tubular body member 10 is made of a cylindrical shape member closed at one end thereof wherein an explosive charge 12 is arranged at the closed end of the tubular body member 10. On the other hand, a pair of terminal leads 14 and 16 which constitute electrodes are provided in the interior of the metallic tubular body member 10, a filament 18 being rigidly connected between both ends of the terminal leads 14 and 16. An igniting charge 20 is arranged around the filament 18. The terminal leads 14 and 16 are connected to well known shock detector and heating source (not shown) through conduits 22 and 24 respectively, whereby filament current is supplied upon application of a great shock force to the vehicle.

Figure 2:
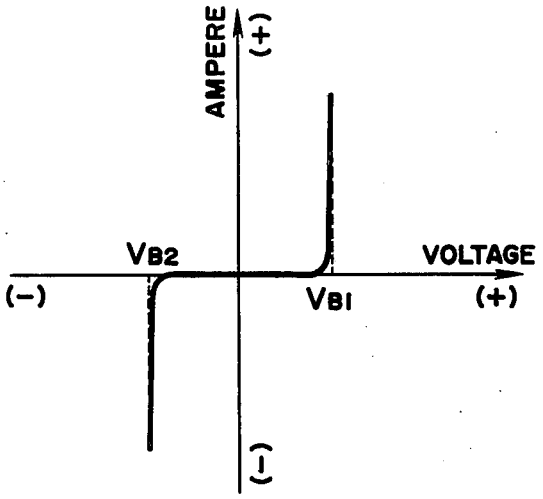
FIG. 2 is a performance characteristic graph showing voltage-current relationship manifested by the non-linear resistor element associated with the present invention.
Figure 3:
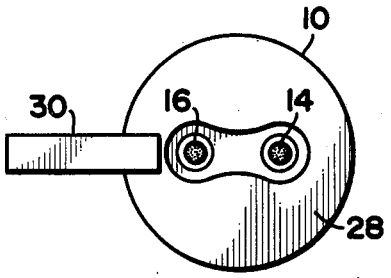
FIG. 3 is a plan view showing the arrangement of electrodes on one surface of the non-linear resistor element illustrated in the embodiment of FIG. 1.
Figure 4:
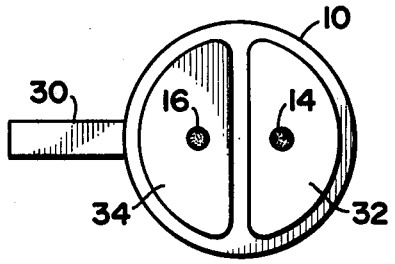
FIG. 4 is a plan view showing arrangement of electrodes on another surface of the non-linear resistor element illustrated in the embodiment of FIG. 1.

Referring now to FIG. 1, it is easily found that the leads 14 and 16 pass through a substantially disc-shaped resistor element of non-linear type 26. In this preferred embodiment in accordance with the present invention, ZNR (Non-linear resistor element of zinc oxide), is used as a non-linear resistor element 26. As shown in FIG. 2, giving a characteristic curve of voltage-current relation provided by ZNR, the ZNR has critical points $V_{B1}$ and $V_{B2}$ respectively which upon application of positive or negative voltages presents high resistance values in the range from $V_{B1}$ and $V_{B2}$, while presenting low resistance values in the range exceeding $V_{B1}$ or $V_{B2}$. In this invention the non-linear resistor element 26 can consist of a constant-voltage diode which has the characteristic of non-linear resistance. As can be seen in FIG. 3 in further detail, a first electrode 28 is attached to one surface of the non-linear resistor element 26 so as not to contact any of the leads 14 and 16, while the first electrode 28 and the tubular body member 10 are electrically connected by way of a thin lead strip 30 fixed on the first electrode by soldering. As shown in FIG. 4, in detail, on the other surface of the non-linear resistor element 26 are mounted a second electrode 32 and a third electrode 34, each having a semicircular configuration, wherein the second electrode 32 is fixed on the lead 14 by soldering and the third electrode 34 on the lead 16 is fixed in the same manner. It is preferable that for connection of the respective electrodes 28, 32 and 34 to the resistor element 26, the process of metallic evaporation or chemical plating using silver, copper etc. be employed. The leads 14 and 16 are restrained through a plug member 36 made of silicon rubber provided in the tubular body member 10. Neck portion 38 of the body member 10 is hermetically sealed to plug member 36 by inwardly, mechanically pressing thereon, whereby a good surface contact condition can also be electrically obtained between the tubular body member 10 and the thin lead strip 30.

Figure 5:
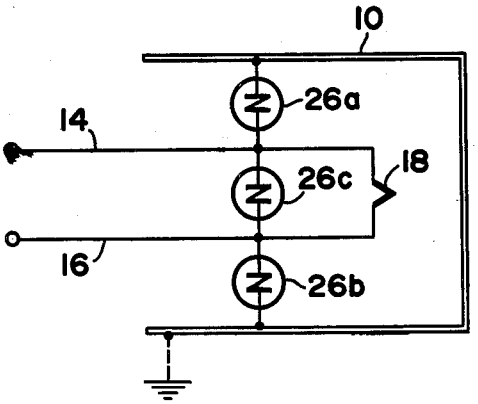
FIG. 5 shows an equivalent circuit diagram of the embodiment depicted in FIG. 1.

A first embodiment in accordance with this invention may be formed of above construction having a non-linear type resistance with the characteristics as given in FIG. 2, and an equivalent circuit thereof is illustrated in FIG. 5. The operational principle of the first embodiment is described as follows. First, referring to the operation of normal ignition, it is effected by the flow of ignition current through the filament 18 by way of the leads 14 and 16. As illustrated in FIG. 2, the resistance value of the non-linear resistor element 26 presents an extremely high value in the range from the critical point $V_{B1}$ to $V_{B2}$. As best seen in FIG. 5, the resistance value of equivalent resistors **26*a*, 26*b* and 26*c* is an exceedingly high value in the event of a normal condition since the resistance value of non-linear resistor element 26 presents an extremely high value in the range from the critical point $V_{B1}$ to $V_{B2}$ and further the voltage values of these points $V_{B1}$ and $V_{B2}$ are set sufficiently higher than that of normal ignition whereby most of ignition currents are supplied to the filament 18 so that the filament 18 is heated rapidly. Then the igniting charge is ignited by the heat energy, thus flames thereof reach the explosive charge enclosed within the interior base of the tubular body member 10**. This results in an explosion of the electric detonating fuse assembly. The arrangement is such that the explosion of the detonating fuse assembly causes destruction of a sealing cock of a compressed air source to provide rapid inflation of the protective air bag to protect the occupant of the vehicle against shock forces applied thereto.

The operation for preventing an abnormal ignition will be better understood from the following description. At the leads 14 and 16 or the tubular body member 10 of the electrical detonating fuse assembly, it may possibly be produced static electricity by various reasons. Accordingly, static voltages are generated between those parts mentioned. If these static voltages are above a predetermined value, a spark discharge will take place between the leads 14, 16 and the tubular body member 10. In accordance with the invention the voltage values of critical points $V_{B1}$ and $V_{B2}$ of the non-linear resistor element 26 are set less than the above spark discharge voltage or breakdown voltage. Accordingly, when the static voltage rises above the predetermined value, currents flow through the path designated by the resistors **26*a* and 26*b* as shown in FIG. 5, thus sparking discharge is not produced. As is apparent from the above description, where static voltages due to electrification are less than the voltage values of critical points $V_{B1}$ and $V_{B2}$ of the non-linear resistor element 26**, sparking discharge is not started while in the range above the critical points, electric charges are immediately released. For this reason, without the static voltages attaining a level higher than that of critical points $V_{B1}$ and $V_{B2}$, it is possible to prevent an abnormal ignition of the igniting charge.

Figure 6:
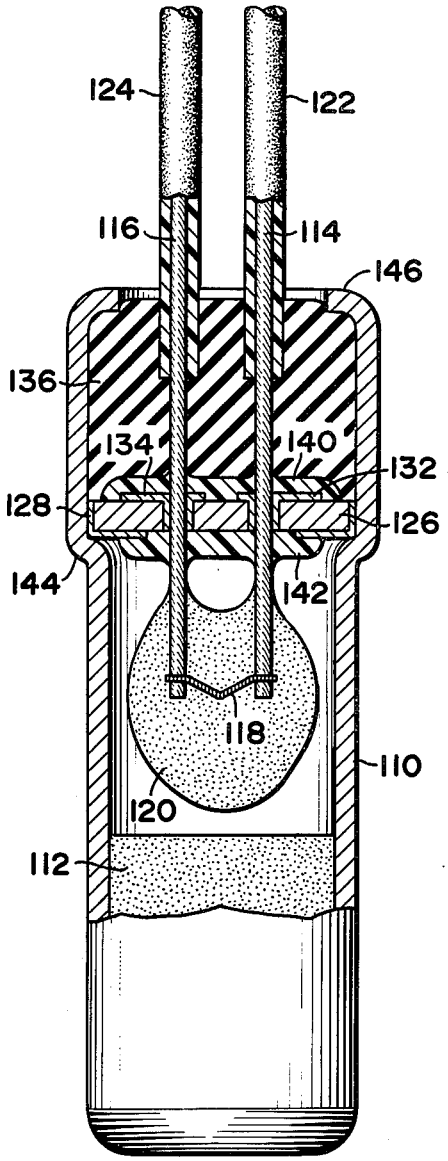
FIG. 6 shows a cross sectional view showing the main structure of a second embodiment of an electric detonating fuse assembly according to the present invention.
Figure 7:
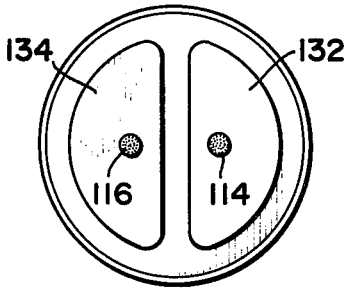
FIG. 7 is a plan view showing the arrangement of electrodes on one surface of the non-linear resistor element illustrated in the embodiment of FIG. 6.
Figure 8:
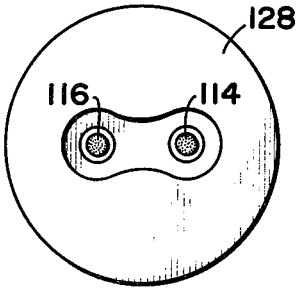
FIG. 8 is a plan view showing the arrangement of electrodes on another surface of the non-linear resistor element illustrated in the embodiment of FIG. 6.

A second embodiment according to the invention is depicted in FIG. 6. As this embodiment is similar to the first embodiment, the numerals shown in the first embodiment to which one hundred (100) is added will be used to designate similar parts of the second embodiment and explanation thereof will be omitted. As seen in FIG. 7, on one surface of the non-linear resistor element 126 are attached by impregnation a second electrode 132 and a third electrode 134 to which the leads 114 and 116 are fixed by soldering, respectively. On the other surface and the sidewall portion of the non-linear resistor element 126 is deposited a first electrode 128 as shown in FIG. 8. Both surfaces of the non-linear resistor element to which the electrodes respectively are fixed in the described manner, are further covered with resin coating members 140 and 142. The leads 114 and 116 enclosed securely in the non-linear resistor element 126 are associated with a plug member 136 made of silicon rubber which is inserted into a tubular body member 110. The body member 110 is provided with a shoulder portion 144. As the first electrode 128 comes into contact with the shoulder portion 144, the non-linear resistor element 126 and the tubular body member 110 are electrically connected with each other. As shown in FIG. 6, one open end portion 146 of the body portion 110 is press bent inwardly, thereby giving shape to the electric detonating fuse assembly. Similarly, the mode of operation described with reference to the first embodiment is applicable to this second embodiment.

As will be apparent from the above description, the electric detonating fuse assembly according to the present invention is capable of preventing occurrence of a high voltage sparking discharge which is a primary factor for causing abnormal ignition, and the assembly presents an extremely high operational reliability.

Although the invention is illustrated and described with reference to a preferred embodiments thereof, it is to be expressly understood that the invention is in no way limited to the disclosure of such preferred embodiments, but is capable of numerous modifications within the scope of the apprended claims.

I claim:

1. An electric detonating fuse assembly, comprising:

a metallic tubular body member having therein an igniting charge and an explosive charge, said body having a closed bottom end and an open neck portion;

a plug member provided in said neck portion of said body member for hermetically sealing sadi body member;

a filament disposed in the vicinity of said igniting charge;

a pair of electric leads connected to said filament through said plug member for supplying igniting current thereto; and a non-linear resistor element disposed between said electric leads and said metallic tubular body member, said resistor element having a critical voltage point selected between a normal igniting voltage preset for normal ignition and a spark discharge voltage causing abnormal ignition due to accumulation of static electricty produced in the assembly whereby the resistor element shows a high value of resistance when applying thereto voltages smaller than said critical voltage, and a low value of resistance when voltages greater than said critical voltage are applied thereto, said non-linear resistor comprising:

a disc-shaped non-linear resistor having first and second sides and having said pair of electric leads extending therethrough;

a pair of semi-circular shaped first and second electrodes provided on said first side of said non-linear resistor and electrically coupled to a one of said electric leads; and a circular third electrode provided on said second side of said disc-shaped non-linear resistor, said circular third electrode being configured such that it is not in contact with said pair of electric leads, said circular third electrode further being electrically coupled to said tubular body member.

2. An electric detonating fuse assembly according to claim 1, wherein said electrodes are attached to the surface of the non-linear resistor element by a metallic evaporation process.

3. An electric detonating fuse assembly according to claim 1, wherein said non-linear resistor element consists of a resistor element of zinc oxide.

4. An electric detonating fuse assembly according to claim 1, wherein said plug member comprises silicon rubber.

5. An electric detonating fuse assembly according to claim 1 further comprising a resin coating provided on said first side of said non-linear resistor covering said first and second electrodes and a resin coating provided on said second side of said non-linear resistor covering said third electrode.

* * * * *